US007583804B2

(12) United States Patent
Suzuki et al.

(10) Patent No.: US 7,583,804 B2
(45) Date of Patent: Sep. 1, 2009

(54) MUSIC INFORMATION ENCODING/DECODING DEVICE AND METHOD

(75) Inventors: Shiro Suzuki, Kanagawa (JP); Minoru Tsuji, Chiba (JP); Keisuke Toyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 695 days.

(21) Appl. No.: 10/534,175

(22) PCT Filed: Oct. 10, 2003

(86) PCT No.: PCT/JP03/13084

§ 371 (c)(1),
(2), (4) Date: May 5, 2005

(87) PCT Pub. No.: WO2004/044891

PCT Pub. Date: May 27, 2004

(65) Prior Publication Data

US 2006/0153402 A1 Jul. 13, 2006

(30) Foreign Application Priority Data

Nov. 13, 2002 (JP) ..... 2002-330024

(51) Int. Cl.
*H04R 5/00* (2006.01)

(52) U.S. Cl. ..... 381/22; 381/23; 704/230

(58) Field of Classification Search ..... 381/22, 381/23; 704/225, 226, 230; 700/94
See application file for complete search history.

(56) References Cited

U.S. PATENT DOCUMENTS 5,115,240 A * 5/1992 Fujiwara et al. ..... 341/51
6,779,015 B1 * 8/2004 Chiang et al. ..... 708/606
6,922,667 B2 * 7/2005 Tsushima et al. ..... 704/219
7,027,982 B2 * 4/2006 Chen et al. ..... 704/230

(Continued)

FOREIGN PATENT DOCUMENTS

JP 01-28700 1/1989

(Continued)

OTHER PUBLICATIONS

Schulz, D.; Improving Audio Codecs by Noise Substitution; Journal of the Audio Engineering Socieity, Audio Engineering Society, New York, NY; US; vol. 44, No. 7/8; Jul. 1996.

(Continued)

*Primary Examiner*—Vivian Chin
*Assistant Examiner*—Jason R Kurr
(74) *Attorney, Agent, or Firm*—Sonnenschein Nath & Rosenthal LLP

(57) ABSTRACT

In an audio-information encoding apparatus, in order to encode an audio signal containing a white-noise component, an index iL indicating the energy level of the white-noise component and an index iR designating the start index of a random-number table are introduced into a code train. In an audio-information decoding apparatus (20), a white-noise generating unit (25) uses the indices iL and iR contained in the code train, thereby generating a white-noise signal Sw(t) on the time axis, which has the same level as the white noise, and an adder (26) adds the white-noise signal to an audio signal Sf(t) decoded on the time axis, outputting as an output audio signal So(t).

12 Claims, 11 Drawing Sheets

U.S. PATENT DOCUMENTS

2002/0152085 A1 10/2002 Tsushima et al.

FOREIGN PATENT DOCUMENTS

| | | | |
|---|---|---|---|
| JP | 64-028700 | | 1/1989 |
| JP | 04-258037 | A | 9/1992 |
| JP | 09-261064 | | 10/1997 |
| JP | 10-065546 | | 3/1998 |
| JP | 10-65546 | | 3/1998 |
| JP | 2001-094507 | A | 4/2001 |
| WO | WO 97/15916 | A1 | 5/1997 |
| WO | 99/04506 | | 1/1999 |

OTHER PUBLICATIONS

Herre J. et al.; Extending the MPEG-4 AAC Codeck by Perceptual Noise Substitution; Preprints of papers presented at the AES Convention; 1998; pp. 1-14.

European Search Report dated Jul. 31, 2007.

An office action from the Japanese Patent Office for Japanese Patent document 2002-330024 issued Nov. 18, 2008.

Japanese Patent Office, Office Action issued in Japanese patent application 2002-330024, on Mar. 24, 2009.

European Patent Office, Communication pursuant to Article 94(3) EPC issued for European patent application No. 03754092.9, Munich, Germany, Jun. 5, 2009.

* cited by examiner

| iL | Level |
|---|---|
| 0 | 1 |
| 1 | 2 |
| 2 | 4 |
| 3 | 8 |
| 4 | 16 |
| 5 | 32 |
| 6 | 64 |
| 7 | 128 |

FIG.9

| iR | iRT |
|---|---|
| 0 | 8 |
| 1 | 1005 |
| 2 | 912 |
| 3 | 63 |
| 4 | 567 |
| 5 | 281 |
| 6 | 736 |
| 7 | 459 |

FIG.10

MUSIC INFORMATION ENCODING/DECODING DEVICE AND METHOD

TECHNICAL FIELD

The present invention relates to an audio-information encoding apparatus and an audio-information encoding method, both of which encode audio information containing white-noise components, a recording medium that stores the code trains generated by the audio-information encoding apparatus and method, an audio-information decoding apparatus and an audio-information decoding method, both of which decode the code trains generated by the audio-information encoding apparatus and method, and a program that causes computers to execute the process of encoding or decoding such audio information.

This application claims priority of Japanese Patent Application No. 2002-330024, filed on Nov. 13, 2002, the entirety of which is incorporated by reference herein.

BACKGROUND ART

To encode an input audio signal, the audio signal is hitherto divided on the time axis into blocks for every predetermined time period (frame). The frames are subjected to modified discrete cosine transformation (MDCT), one by one. The time-series signal is thereby transformed to a spectral signal on the frequency axis. (So-called "spectrum transform" is carried out.) Thus, the audio signal is encoded.

To encode spectral signals, bits are allocated to each spectral signal that has been obtained by performing spectral transform on a time-series signal corresponding to one frame. Namely, a prescribed bit allocation or an adaptive bit allocation is carried out. For example, bit allocation may be performed in order to encode coefficient data generated by the MDCT processing. In this case, an appropriate number of bits are allocated to the MDCT coefficient data acquired by performing the MDCT processing on the time-axis signal for each block.

The bit allocation is detailed in, for example, R. Zelinski and P. Noll, "Adaptive Transform Coding of Speech Signals," IEEE Transactions of Accoustics, Speech and Signal Processing, Vol. ASSP-25, August 1977, and M. A. Kransner, MIT, "The Critical Band Coder Digital Encoding of the Perceptual Requirements of the Audiotory System," ICASSP 1980.

Any audio signal input to an encoding apparatus contains various components such as the sounds of musical instruments and human voice. Even if a microphone records only voice or piano sound, the resultant signal does not represent the voice or piano sound alone. The signal usually contains background noise, i.e., the sound the recording device makes while being used, and also the electrical noise the recording device generates.

These noises, as well as the voice and piano sound, are no more than linear waveform information to the encoding apparatus. The apparatus will perform frequency-encoding on the noise components, too. This is a correct approach from a viewpoint of waveform-reproducibility. In view of the human auditory characteristics, however, this cannot be said to be an efficient encoding method.

Thus, bit allocation based on a psychological auditory model may be carried out. That is, no bit allocation is performed on any frequency component that is smaller than the lowest audible level at which man can hear nothing, or smaller than the minimum encoding threshold value arbitrarily set in the encoding apparatus.

FIG. 1 outlines the configuration of a conventional encoding apparatus that performs such bit allocation as described above. In the encoding apparatus 100, a time-to-frequency transforming unit 101 transforms an input audio signal Si(t) to a spectral signal F(f) as is illustrated in FIG. 1. The spectral signal is supplied to a bit-allocation frequency-band determining unit 102. The bit-allocation frequency-band determining unit 102 analyzes the spectral signal F(f). It then divides the spectral signal into a frequency component F(f0) and a frequency component F(f1). The frequency component F(f0) is at a level equal to or higher than the lowest audible level, or is equal to or greater than the minimum encoding-threshold value, and will be subjected to bit allocation. The frequency component F(f1) will not be subjected to bit allocation. Only the frequency component F(f0) is supplied to a normalization/quantization unit 103. The frequency component F(f1) is thus discarded.

The normalization/quantization unit 103 carries out normalization and quantization on the frequency component F(f0), generating a quantized value Fq. The value Fq is supplied to an encoding unit 104. The encoding unit 104 encodes the quantized value Fq, generating a code train C. A recording/transmitting unit 105 records the code train C in a recording medium (not shown) or transmits the code train as a bit stream BS.

The code train C generated by the encoding apparatus 100 may have such a format as is shown in FIG. 2. As FIG. 2 depicts, the code train C is composed of a header H, normalization information SF, quantization precision information WL, and frequency information SP.

FIG. 3 outlines the configuration of a decoding apparatus that may be used in combination with the encoding apparatus 100. In the decoding apparatus 120, a receiving/reading unit 121 restores the code train C from the bit stream BS received from the encoding apparatus 100, or from the recording medium (not shown), as is illustrated in FIG. 3. The code train C is supplied to a decoding unit 122. The decoding unit 122 decodes the code train C, generating a quantized value Fq. An inverse-quantization/inverse-normalization unit 123 performs inverse quantization and inverse normalization on the quantized value Fq, thus generating a frequency component F(f0). A frequency-to-time transforming unit 124 transforms the frequency component F(f0) to an output audio signal So(t). The output audio signal So(t) is output from the decoding apparatus 120.

FIG. 4 illustrates a case where no bit allocation is performed on any frequency component that is, in all frames, at a level lower than the lowest audible level A. As FIG. 4 shows, only frequency components of 0.60 f or less are encoded in the (n−1)th frame, all frequency components up to 1.00 f are encoded in the n-th frame, and only frequency components of 0.55 f or less are encoded in the (n+1)th frame. As a result, a component of a specific frequency is contained in some frame, and is not contained in some others. Nonetheless, the code train can equivalently contain all frequency components for all frames, because the components of the frequencies, not contained in the code train is absolutely inaudible to man. Hence, the music reproduced from the code train does not make the listener feel any psychological auditory strangeness.

When all frequency components at levels equal to or higher than the lowest audible level are encoded, however, those components that are not important or the white noise that need not be heard are encoded, too. The encoding is therefore inefficient. Assume that the frequency components are encoded at a fixed bit rate, thus allocating the same number of bits to each frame. Then, some frames may fail to have a number of bits, large enough to reproduce sound of satisfactory quality, if the bit rate is too low.

FIG. 5 illustrates a case where no bit allocation is performed on any frequency component that has a value smaller than the minimum encoding threshold value a set for each frame. As FIG. 5 shows, the encoding apparatus sets a minimum encoding threshold value a(n−1) for the (n−1)th frame. This value a(n−1) is regarded as not influencing the sound quality even if it is not recorded in the (n−1)th frame. This is because any component that has a frequency lower than this value is not so important to sound quality. As a result, only frequency components of 0.60 f or less are encoded in the (n−1)th frame.

If the frequency component that is not encoded has the same value in all frames, all frequency components encoded are considered as equivalent to components that are encoded after passing a low-pass filter. The band may therefore be perceived as narrowed in some cases. Nevertheless, this sense of a narrowed band is not so problematical in consideration of the original frequency distribution and the auditory characteristics of man.

However, the next frame, i.e., the n-th frame, has but small energy and has more frequency components not encoded, than the (n−1)th frame. In the (n+1)th frame, which has large energy, all frequency components are encoded since the encoding apparatus determines that they are important to the auditory sense.

If the frequency components contained in the code train so vary from frame to frame, they will jeopardize the continuity of frames when they are reproduced. They may be felt as obvious noise. This noise is similar to the background noise of FM broadcasting, which varies with time as the condition of radio wave changes. Consequently, the listener feels that the music contains a specific noise, inevitably perceiving psychological auditory strangeness.

Jpn. Pat. Appln. Laid-Open Publication No. 8-166799 filed by the applicant hereof discloses a technique of preventing the generation of noise. In the technique, the bandwidth in which bit allocation has been performed on the preceding frame is recorded and stored. The bandwidth to perform bit allocation to the present frame is determined, not so much different from that bandwidth. This controls the changes in the reproduction band and ultimately prevents generation of noise.

The technique disclosed in Jpn. Pat. Appln. Laid-Open Publication No. 8-166799 indeed helps to stabilize the reproduction band. However, it cannot completely solve the auditory problem since it allows for fluctuation of the reproduction band.

To stabilize the reproduction band, components of frequencies falling within a band inherently unnecessary may be recorded, or components of frequencies falling within a band inherently necessary may not be recorded. Either case is undesirable in view of encoding efficiency.

All frequencies may be analyzed for several frames or several tens of frames, and the same frequency at which bit allocation should be performed may be applied to all frames. This method is not practical, however, in view of the real-time processing required and the cost of memories and processors incorporated in the public-use hardware. Further, the method does not seem to increase the encoding efficiency.

DISCLOSURE OF THE INVENTION

This invention has been made in view of the foregoing. An object of the invention is to provide an audio-information encoding apparatus and an audio-information encoding method, both of which efficiently encode audio information containing white-nose components and prevent the generation of noise even if the reproduction band changes from frame to frame. Another object of the invention is to provide a recording medium that stores the code trains generated by the audio-information encoding apparatus and method. Still another object of the invention is to provide an audio-information decoding apparatus and an audio-information decoding method, both of which decode the code trains generated by the audio-information encoding apparatus and method. Another object of the invention is to provide a program that causes computers to execute the process of encoding or decoding such audio information.

To achieve the first object mentioned above, an audio-information encoding apparatus and an audio-information encoding method, both according to this invention, divide an audio signal on a time axis into blocks for every predetermined time period, frequency transform and encode each block, thereby encoding the audio signal. To encode the audio signal, a white-noise component contained in the audio signal is analyzed, and an index indicating the energy level of the white-noise component analyzed is encoded.

The white-noise component may be analyzed on the basis of the energy distribution at the high-band part of the block, or on the basis of the energy distribution of the entire block.

Further, an index of a random-number table that is used to generate a white-noise component in a decoding side may be encoded.

To attain the second object mentioned above, a recording medium according to the invention stores a code train. The code train has been generated by dividing an audio signal on a time axis into blocks for every predetermined time period, frequency transforming and encoding each block, thereby encoding the audio signal, and by analyzing a white-noise component contained in the audio signal, and by encoding an index indicating the energy level of the white-noise component.

To achieve the third object mentioned above, an audio-information decoding apparatus and an audio-information decoding method, both according to the invention, decode a coded frequency signal and perform inverse frequency transformation on the signal, thereby generating an audio signal on the time axis. In the process of generating an audio signal, a white-noise component on the time axis is generated on the basis of an index indicating the energy level of a coded white-noise component, and the audio signal generated on the time axis by means of the inverse frequency transformation is added to the white-noise component on the time axis.

The white-noise component may be generated on the basis of the encoded indices of a random-number table. Alternatively, the white-noise component may be generated on the basis of a specific value contained in a code train.

In the audio-information encoding apparatus and method and the audio-information decoding apparatus and method, when an audio signal containing the white-component is encoded, the energy-level index of the white-noise component is added to a code train in the encoding side, white noise at the same level as the white-noise component is generated in the decoding side, and the white noise thus generated is added to the decoded audio signal on the time axis.

A program according to the present invention causes a computer to perform the audio-information encoding process described above, or the audio-information decoding process described above.

The other objects of this invention and the advantages attained by this invention will be more apparent from the following description of embodiments.

BRIEF DESCRIPTION OF DRAWINGS

FIG. 9 is a diagram showing an example of a white-noise level table used to generate index iL;

FIG. 10 is a diagram showing an example of a random-index table used to generate index iR;

BEST MODE FOR CARRYING OUT THE INVENTION

Embodiments of the present invention will be described in detail, with reference to the accompanying drawings. The embodiments are: an audio-information encoding apparatus and an audio-information encoding method, both of which efficiently encode audio information containing white-nose components and prevent the generation of noise due to fluctuation the reproduction band with time; and an audio-information decoding apparatus and an audio-information decoding method, both of which decode the code trains generated by the audio-information encoding apparatus and method. The principle of the audio-information encoding method, and that of the audio-information decoding method will be first explained. Then, the configuration of the audio-information encoding apparatus, and that of the audio-information decoding apparatus will be explained.

In the audio-information encoding method according to an embodiment of this invention, an audio signal input is divided on the time axis into blocks for every predetermined time period (frame). The frames are subjected to modified discrete cosine transformation (MDCT), one by one. The time-series signal on the time axis is thereby transformed to a spectral signal on the frequency axis. (So-called "spectrum transform" is carried out.) To encode the signal efficiently, in consideration of the human auditory characteristics, no bit allocation is performed on any frequency component that is smaller than the minimum encoding threshold value a that can be set to each frame by bit allocation based on a psychological auditory model.

Figure 1:
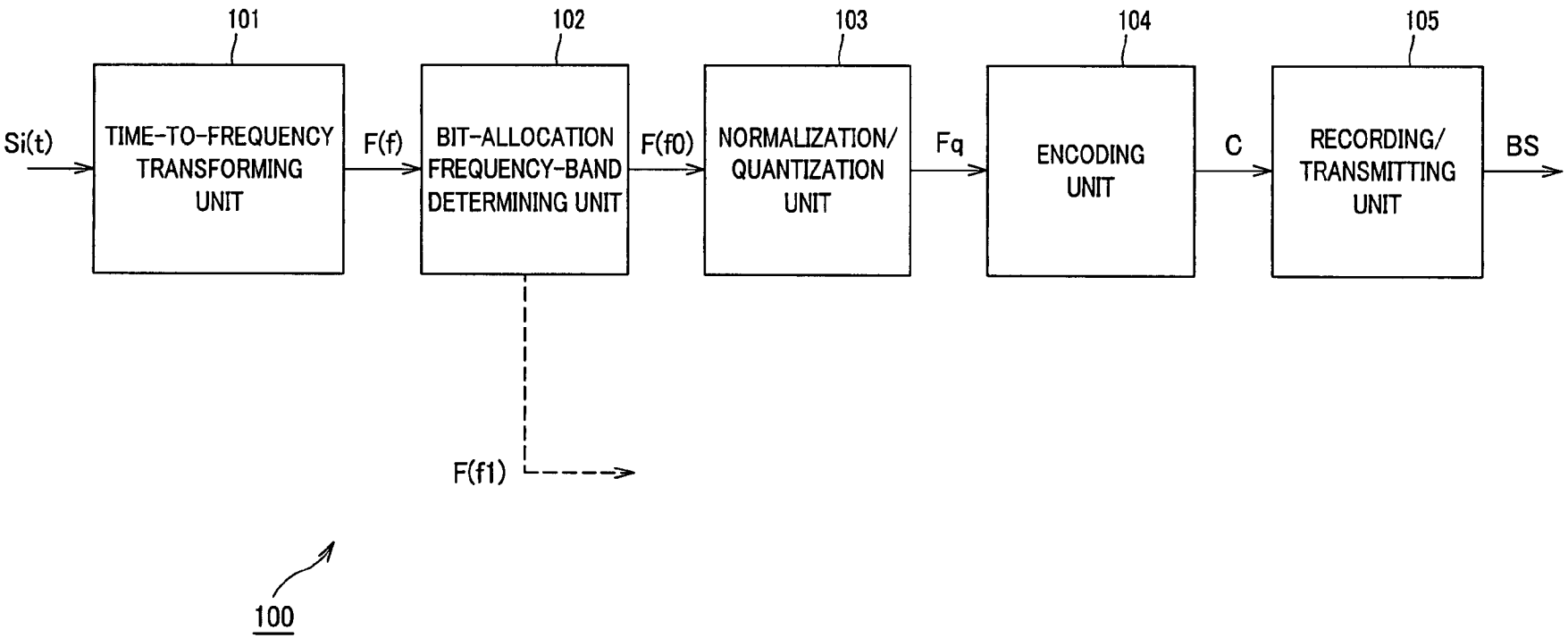
FIG. 1 is a diagram outlining the configuration of a conventional encoding apparatus.
Figure 2:
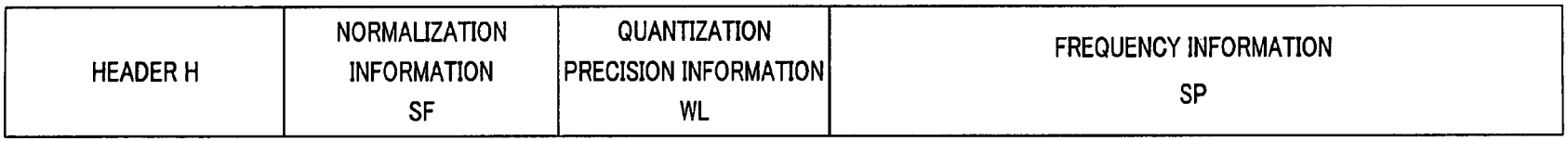
FIG. 2 is a diagram showing an example of a code train generated by the encoding apparatus.
Figure 3:
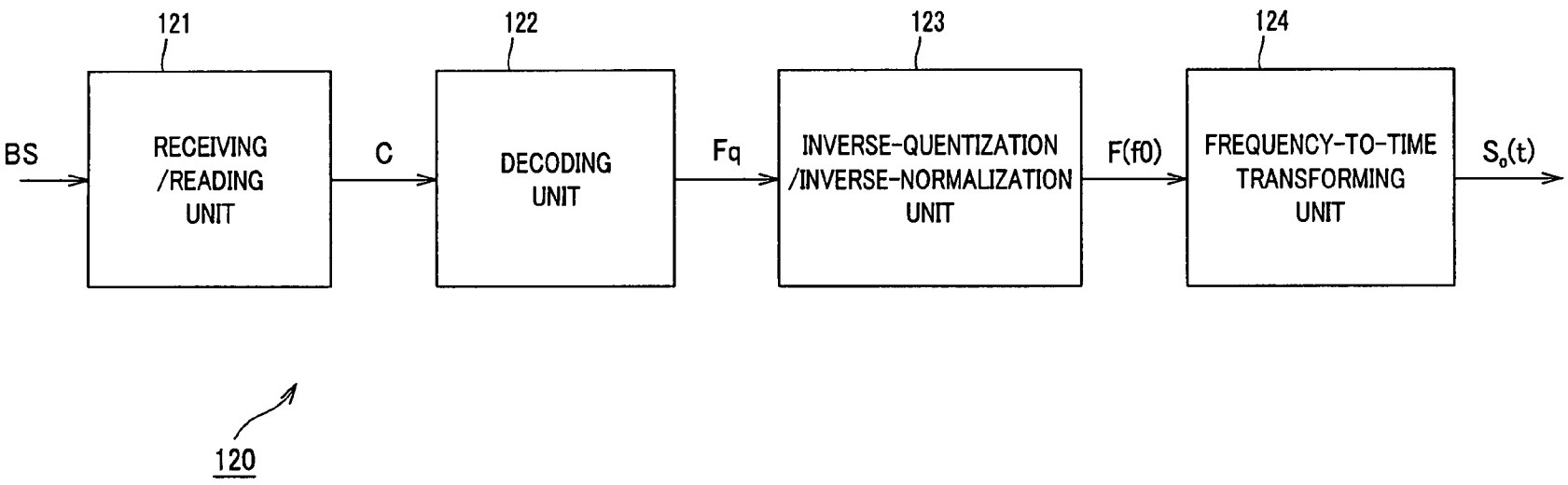
FIG. 3 is a diagram outlining the configuration of a conventional decoding apparatus.
Figure 4:
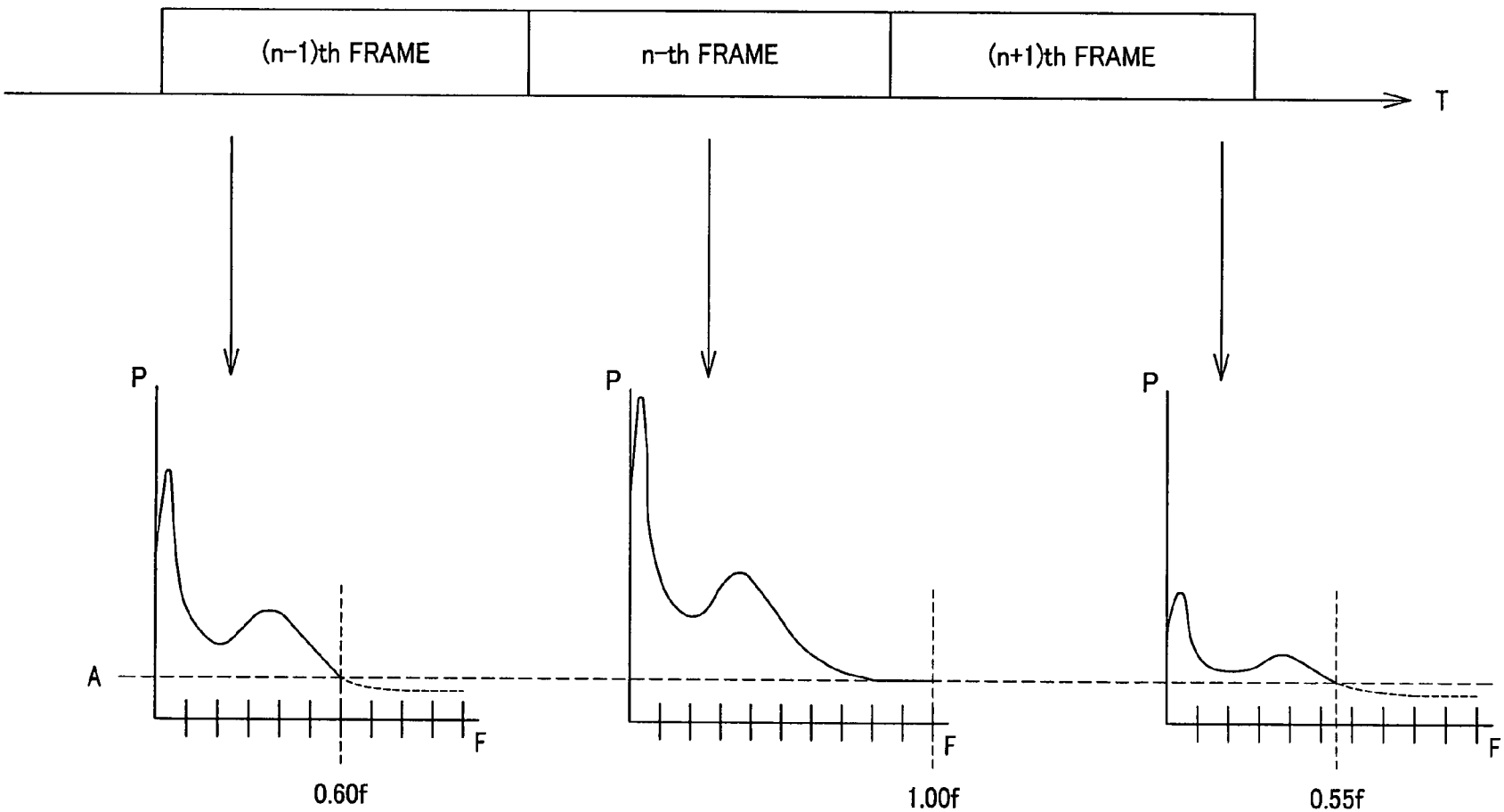
FIG. 4 illustrates a case where the encoding apparatus performs no bit allocation on any frequency component that is at a level lower than the lowest audible level.
Figure 5:
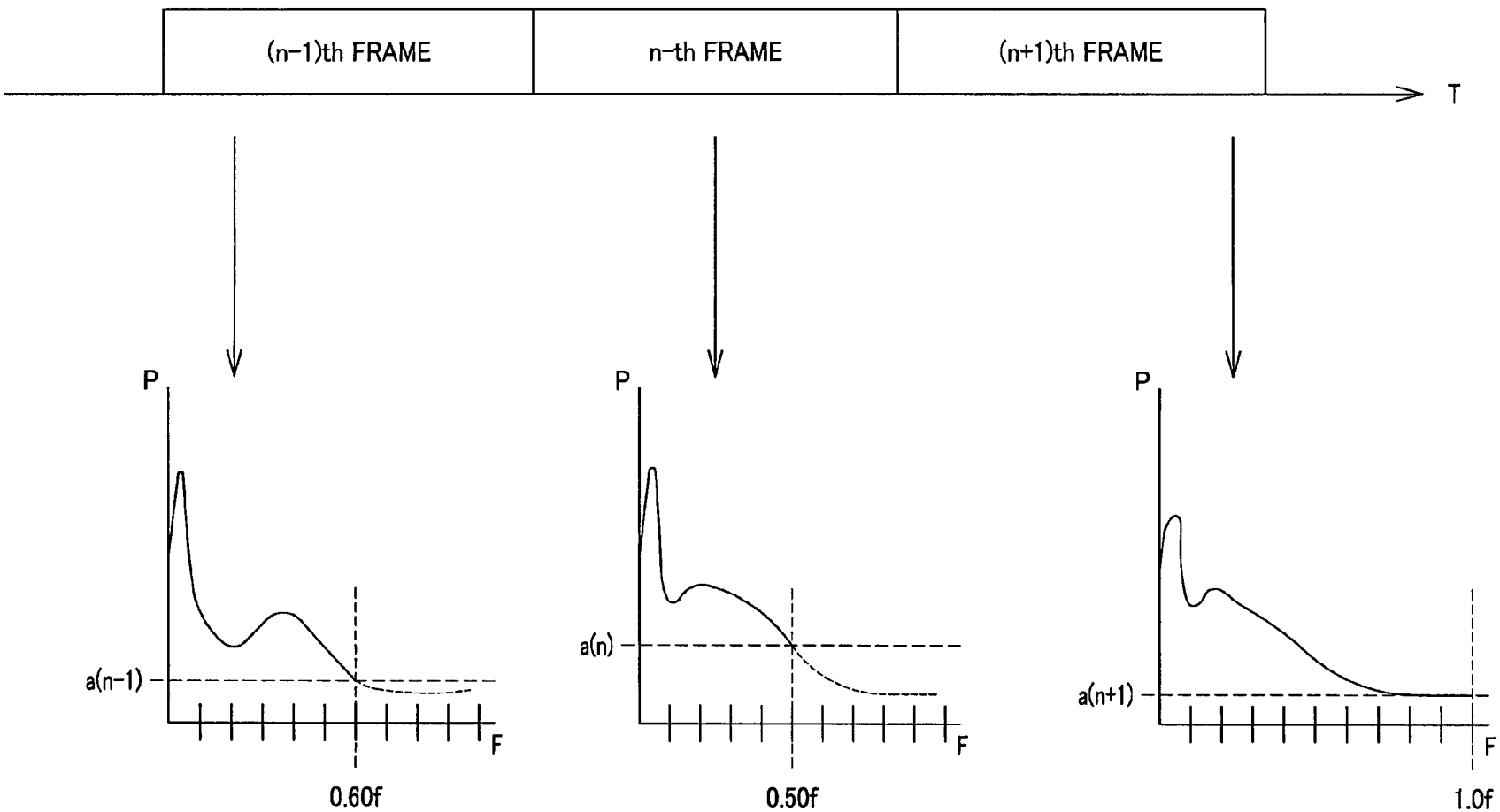
FIG. 5 illustrates a case where the encoding apparatus performs no bit allocation on any frequency component that has a value smaller than the minimum encoding threshold value.
Figure 6:
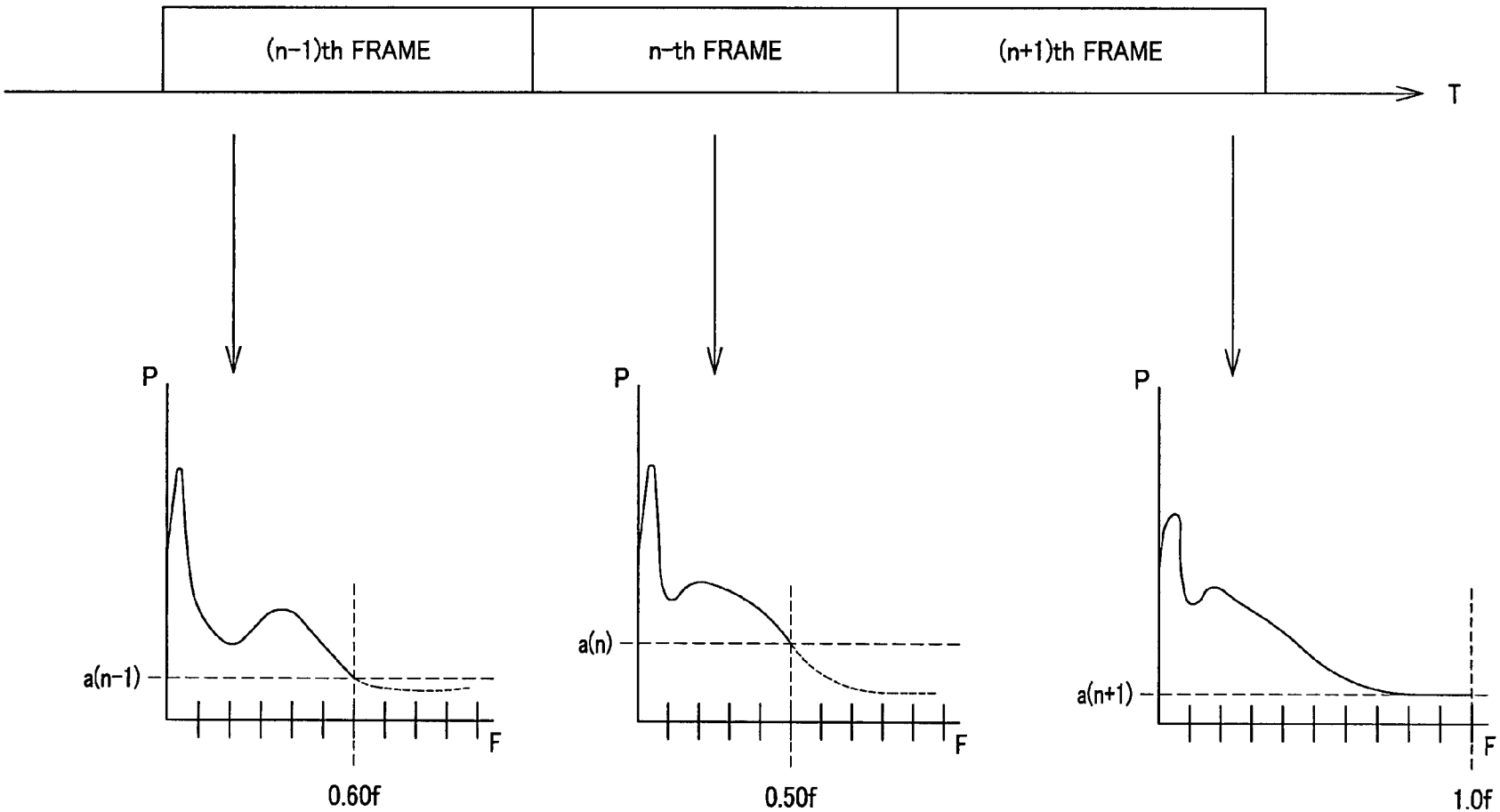
FIG. 6 is a diagram representing the minimum encoding threshold value and white-noise level for each frame in the encoding side.

As FIG. 6 shows, a minimum encoding threshold value a(n−1) is set for the (n−1)th frame. This minimum encoding threshold value a(n−1) is regarded as not influencing the sound quality if it is not recorded in the (n−1)th frame. This is because any component that has a frequency lower than this value is not so important to sound quality. As a result, bit allocation is performed on only frequency components of 0.60 f or less in the (n−1)th frame.

In the next frame, i.e., the n-th frame, the minimum encoding threshold value a is set to a(n) level, and bit allocation is performed on only frequency components of 0.50 f or less.

In the (n+1)th frame, the minimum encoding threshold value a is set to a(n+1) level, and bit allocation is carried out on all frequency components up to 0.10 f.

Any frequency component that has a value smaller than the minimum encoding threshold value a may not be discarded and not contained in the code train. If this is the case, the reproduction band varies from frame to frame when the frequency components are reproduced. Consequently, the continuity of frames is no longer preserved. This makes the listener feel psychological auditory strangeness.

To prevent this from happening, white-noise components in any high-band frequency component that has a value smaller than minimum encoding threshold value a are analyzed in the present embodiment. Then, an index obtained by quantizing the average energy level of a region, which satisfies the following conditions is contained in the code train.

(a) Its energy distribution is sufficiently small and flat.

(b) The frequency components in it contain noise.

The frequency distribution in a region may be flat and the ratio of the highest frequency fmax to the average frequency fave (fmax/fave) may be equal to or less than about 3.0 in the region. In this case, the frequency components in this region have no periodicity and contain noise, as is experimentally proved.

In the case shown in FIG. 6, white-noise levels b(n−1), b(n) and b(n+1), each matching a flat-frequency energy level in a high band, are detected for the (n−1)th frame, the n-th frame and the (n+1)th frame, respectively. The white-noise levels are changed to indices, which are added to the code train.

In the audio-information decoding method according to the present embodiment, the frequency components in the code train are subjected to inverse spectral transform and thereby decoded. In addition, white noise is generated, which has the energy level indicated by the index.

Figure 7:
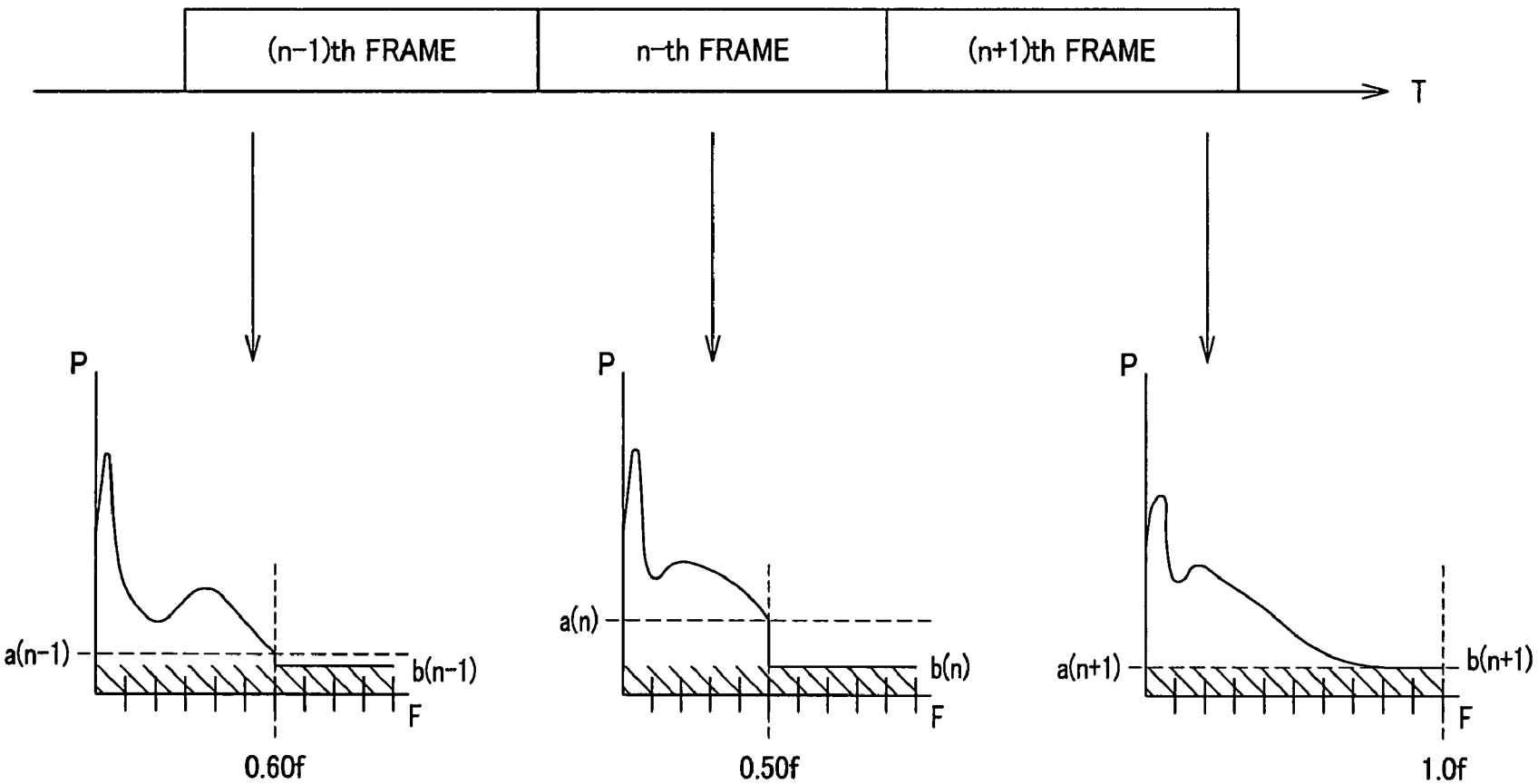
FIG. 7 is a diagram showing an example of white noise generated in the decoding side.

As a result, the band of the reproduced frequency components contained in the code train varies from frame to frame as shown in FIG. 7. Nonetheless, the psychological auditory strangeness can be effectively reduced since pseudo-high-frequency components are generated from the white noise.

There is a gap between the energy level of any frequency component that should not be added to the code train in the encoding side and the energy level of the white noise generated in the decoding side. This gap would not adversely influence the auditory perception on the part of the listener, because the auditory strangeness originates mainly from the fact that energy of a certain frequency band totally ceases to exist.

Figure 8:
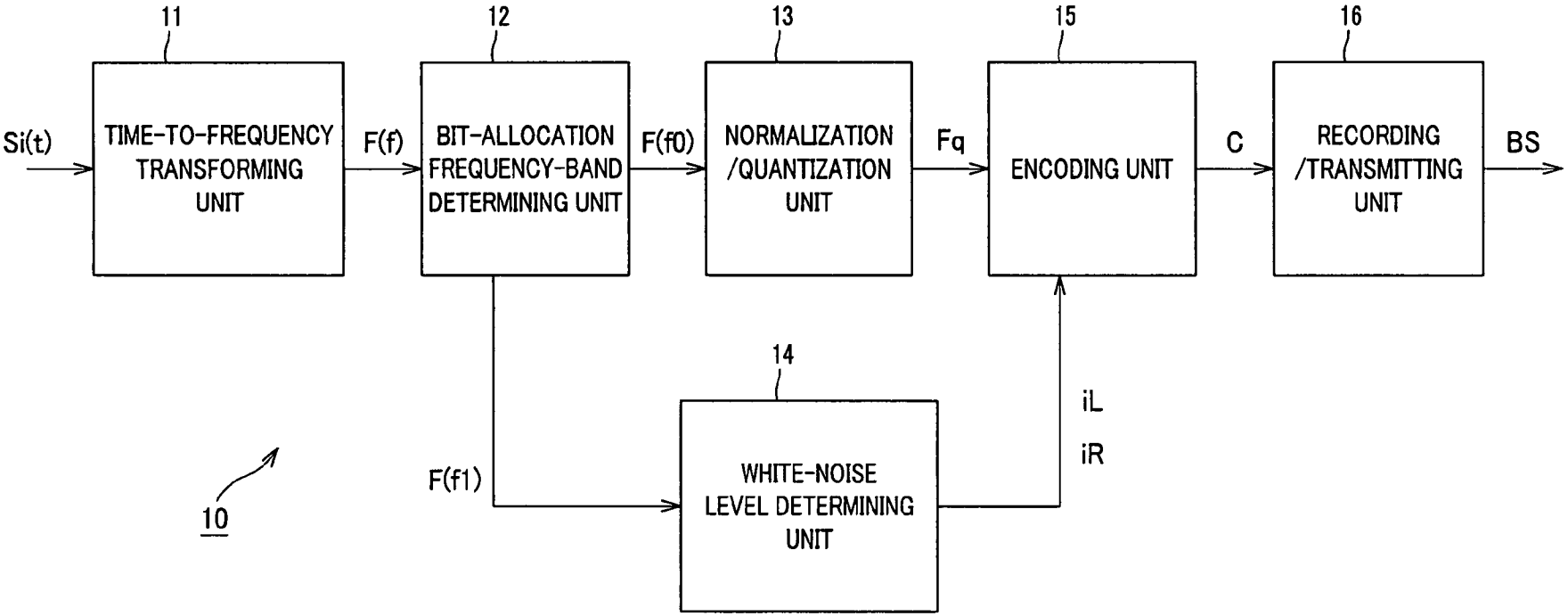
FIG. 8 is a diagram outlining the configuration of an audio-information encoding apparatus that is an embodiment of this invention.

FIG. 8 outlines the configuration of the audio-information encoding apparatus according to this embodiment, which performs the above-mentioned process. In the audio-information encoding apparatus 10 shown in FIG. 8, a time-to-frequency transforming unit 11 transforms an input audio signal Si(t) to a spectral signal F(f). The spectral signal F(f) is supplied to a bit-allocation frequency-band determining unit 12.

The bit-allocation frequency-band determining unit 12 analyzes the spectral signal F(f). It then divides the spectral signal into a frequency component F(f0) and a frequency component F(f1). The frequency component F(f0) has a value equal to or greater than the minimum encoding threshold value a and will be subjected to bit allocation. The frequency component F(f1) will not be subjected to bit allocation. Only the frequency component F(f0)) is supplied to a normalization/quantization unit 13. The frequency component F(f1) is supplied to a white-noise level determining unit 14.

The normalization/quantization unit 13 carries out normalization and quantization on the frequency component F(f0), generating a quantized value Fq. The value Fq is supplied to an encoding unit 15.

The white-noise level determining unit 14 analyzes the white-noise component extracted from the frequency component F(f1), generating an index iL. The index iL, which is obtained by quantizing the white-noise level, indicates an average energy level of a region, which satisfies the above-mentioned conditions. If the index iL is represented by three bits, the white-noise level table that is used to generate the index iL is of the type illustrated in FIG. 9. In this example, the index iL is 3 if the white-noise level is about 8 dB.

The white-noise level determining unit 14 generates an index iR, too. The index iR designates a start index iRT of a random-number table that must be used to generate white noise in the decoding side. This index iR may be represented by three bits. If this is the case, the random-number index table for generating the index iR is of the type shown in FIG. 10.

The encoding unit 15 encodes the quantized value Fq supplied from the normalization/quantization unit 13 and the indices iL and iR supplied from the white-noise level determining unit 14. The unit 15 generates a code train C. A recording/transmitting unit 16 records the code train C in a recording medium (not shown) or transmits the code train as a bit stream BS.

Figure 11:
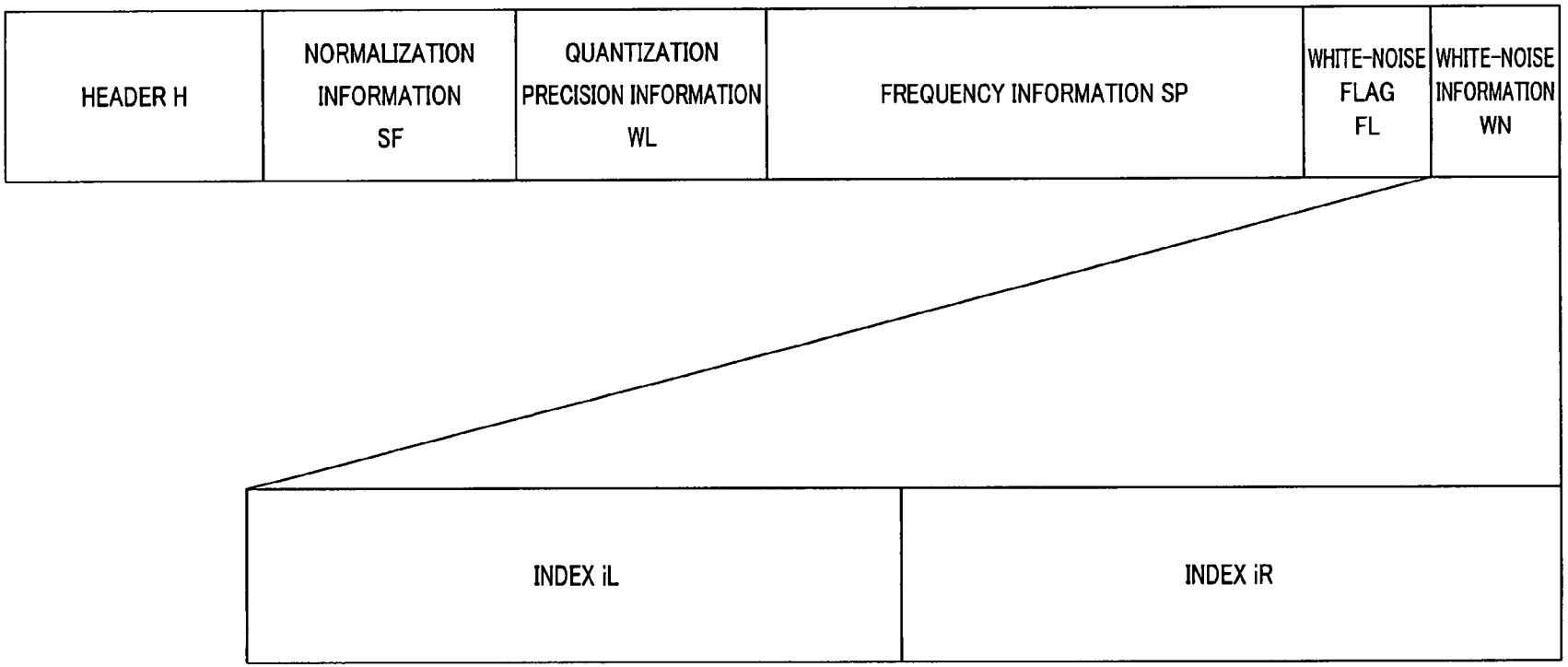
FIG. 11 is a diagram depicting an example of a code train generated in the audio-information encoding apparatus.

The code train C generated by the encoding apparatus 10 has such a format as is shown in FIG. 11. As seen from FIG. 11, the code train C is composed of not only a header H, normalization information SF, quantization precision information WL and frequency information SP, but also a white-noise flag FL and white-noise information WN. The white-noise information WN consists of indices iL and iR. The white-noise information WN is contained in the code train C if the white-noise flag FL is "1." If the white-noise flag FL is "0," the white-noise information WN is not contained in the code train C. In this case, the overflowing bit is used in encoding the frequency component F(f0).

The white-noise flag FL may not set, and all frequency components in the frame may have values equal to or greater than the minimum encoding threshold value a. In this case, the code train C may contain the indices iL and iR of the preceding frame.

Figure 12:
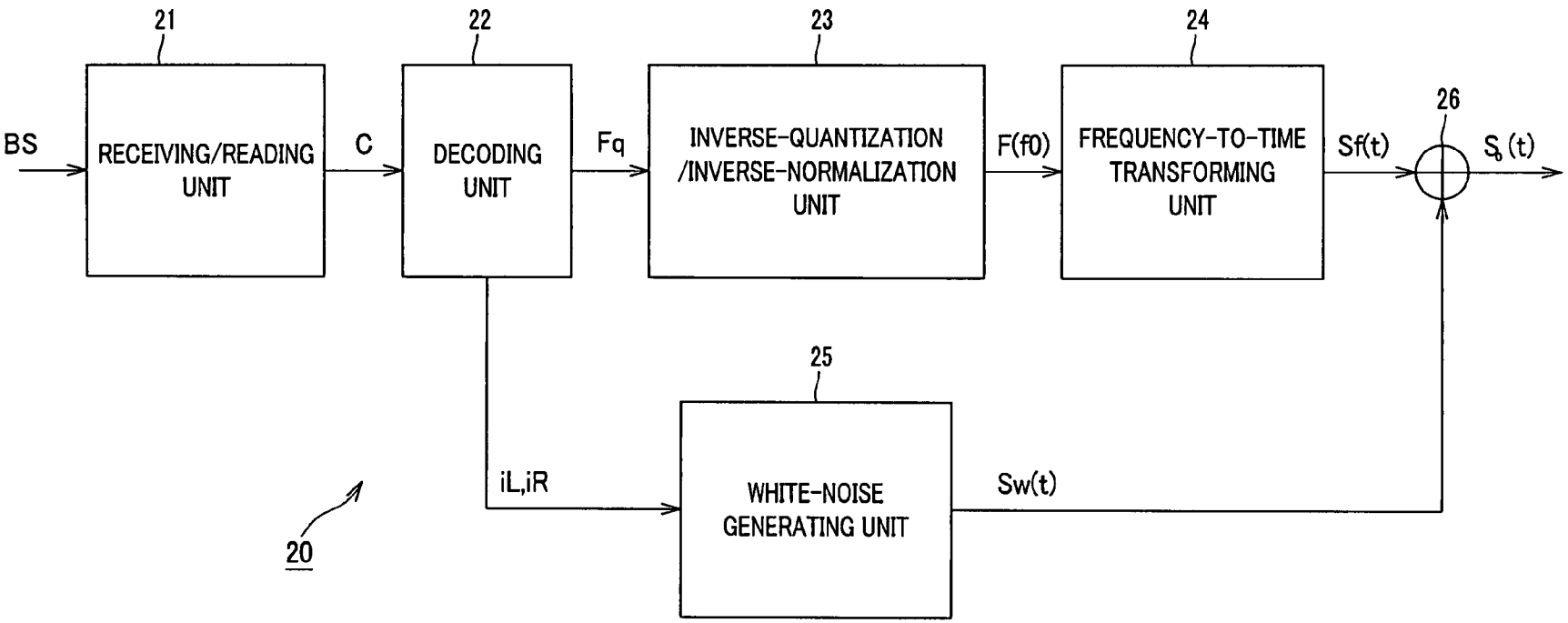
FIG. 12 is a diagram outlining the configuration of an audio-information decoding apparatus that is an embodiment of the present invention.

FIG. 12 outlines the configuration of an audio-information decoding apparatus that may be used in combination with the encoding apparatus 10. In the decoding apparatus 20, a receiving/reading unit 21 restores the code train C from the bit stream BS received from the encoding apparatus 10, or from the recording medium (not shown), as is illustrated in FIG. 12. The code train C is supplied to a decoding unit 22.

The decoding unit 22 decodes the code train C, generating a quantized value Fq, an index iL and an index iR. The quantized value Fq is supplied to an inverse-quantization/inverse-normalization unit 23, and the indices iL and iR are supplied to a white-noise generating unit 25.

The inverse-quantization/inverse-normalization unit 23 performs inverse quantization and inverse normalization on the quantized value Fq, generating a frequency component F(f0). The frequency component F(f0) is supplied to a frequency-to-time transforming unit 24.

The frequency-to-time transforming unit 24 transforms the frequency component F(f0) to an audio signal Sf(t) on the time axis. The audio signal Sf(t) is supplied to an adder 26.

The white-noise generating unit 25 generates a white-noise signal Sw(t) from the indices iL and iR in accordance with the following equation. The white-noise signal Sw(t) is a time-series signal that corresponds to the frequency component F(f1). This signal Sw(t) is supplied to the adder 26.

$$Sw(t)=LEV(iL)\times RND(iRT+t) \quad (1)$$

where LEV(iL) is a value for a white-noise level table LEV( ) that uses the index iL as argument. RND(iRT+t) is a value for a random-number table RND( ) that uses, as argument, the value obtained by adding the frequency-component number t to the start index iRT that the index iR designates in the random-number index table. The value for random-number table RND( ) is normalized to, for example, −1.0 to 1.0.

The start index iRT of the random-number table is thus generated from the index iR contained in the code train C. It is therefore possible to prevent different white noise from being generated each time.

In the random-number table RND( ), the value of iRT+t may exceed the number of array elements, Nrnd. If this is the case, the value obtained by subtracting the number Nrnd from the value of iRT+t is used as argument for the random-number table RND( ). That is, iRT+1 should be 0 to Nrnd.

In this embodiment, the start index iRT of the random-number table is thus generated from the index iR contained in the code train C. Instead, the index iR may not be generated in the encoding side, and the start index iRT may be generated from a value obtained by adding specific values in the code train, for example, all normalization information SF and all quantization precision information WL for one frame. In this case, too, it is possible to prevent different white noise from being generated each time.

In the case where different white noise is allowed to be generated each time, a random number can be generated in the decoding side, thereby to generate the start index iRT.

The adder 26 adds the audio signal Sf(t) supplied from the frequency-to-time transforming unit 24 and the white-noise signal Sw(t) supplied from the white-noise generating unit 25 on the time axis and outputs as an output audio signal So(t).

The frequency component F(f0) and a frequency component Fw that corresponds to the white-noise signal Sw(t) may be added on the frequency axis, and the resultant component may be subjected to the time-to-frequency transformation, thereby to generate an output audio signal So(t). This method, however, makes a problem when it is employed in combination with such a gain controlling/compensating process preventing pre-echo generation or the like as described in, for example, Jpn. Pat. Appln. Laid-Open Publication No. 7-221648, Jpn. Pat. Appln. Laid-Open Publication No. 7-221649, or the like. Although the frequency component Fw corresponding to the white-noise signal Sw(t) is added on the frequency axis, the gain on the time axis thereafter changes in the gain-compensating circuit. As a consequence, no white-noise signals can be generated. This is why the white-noise signal is generated on the time axis.

As indicated above, in the audio-information encoding apparatus 10 and the audio-information decoding apparatus 20, both according to the present embodiment, all white-noise frequency components are not encoded in the encoding side in order to encode input audio information containing white noise component. Rather, the index iL for the white-noise level and the index iR in the random-number index table are contained in the code train C. Thus, white noise at the same level as the white noise in the input audio information signal can be generated in the decoding side, thereby performing efficient encoding. In addition, it is possible to prevent noise from being generated even if the reproduction band fluctuates from frame to frame.

The present invention is not limited to the embodiments that have been described above with reference to the drawings. To any person skilled in the art, it is obvious that various changes, replacement or equivalents thereof can be made without departing from the scope and spirit of the invention.

For example, each of the above-described embodiments is a hardware configuration. Nevertheless, it is possible to make a central processing unit (CPU) execute a computer program to perform any processes. In this case, the computer program may be provided, as it is stored in a recording medium, or as it is transmitted via a transmission medium such as the Internet.

In the embodiments described above, an audio signal for each frame contains white noise. Nonetheless, this invention can be applied to the case where a frame consists of white noise only, too. If so, the frequency components of each frame are analyzed, and an index iL obtained by quantizing the average energy level of a frame that satisfies the following conditions, or an index iR of the random-number index table is contained in the code train.

(c) The energy distribution over the entire band is sufficiently small (±6 dB, more or less).

(d) The frequency components over the entire band contain noise.

The white noise can be expressed as the sum of the "frequency components" and the "indix iL of white-noise level and index iR of the random-number index table." That is, the frequency components are sequentially subjected to bit allocation, first the component of the greatest energy, then the component of the second largest energy, and so on. Therefore, the lowest waveform reproducibility required can be guaranteed, and any frequency component of small energy can be substituted by the indix iL of white-noise level and the index iR of the random-number index table. This can enhance not only the waveform reproducibility, but also the encoding efficiency. If the bit rate is sufficiently high and high waveform reproducibility is required, many bits may be allocated to the "frequency component." If the bit rate is very low, the "indix iL of white-noise level and index iR of the random-number index table" are used to accomplish low-rate encoding.

INDUSTRIAL APPLICABILITY

As has been described, the present invention can make it possible to encode efficiently an audio signal containing a white-noise component, and to prevent noise from being generated even if the reproduction band fluctuates from block to block. This is because the energy-level index of the white-noise component is added to a code train in the encoding side, white noise at the same level as the white noise is generated in the decoding side, and the white noise thus generated is added to the decoded audio signal on the time axis.

The invention claimed is:

1. An audio-information encoding apparatus for dividing an audio signal on a time axis into blocks for every predetermined time period, frequency transforming and encoding each block, said apparatus comprising:

a white-noise level determining unit for: (i) determining, for each block, a white-noise level of an extracted white-noise component of a frequency transformed audio signal and generating a first index by quantizing the white-noise level contained in the audio signal; and, (ii) generating a second index designating a start location of a random-number table adapted to generate a white-noise component in a decoding side; and an encoding unit that encodes, for each block, (i) a quantized value resulting from normalization and quantization of the frequency transformed audio signal, (ii) the first index, and (iii) the second index.

2. The audio-information encoding apparatus according to claim 1, wherein the white-noise level determining unit determines the white-noise level based on the energy distribution at the high-band part of the block.

3. The audio-information encoding apparatus according to claim 1, wherein the white-noise level determining unit determines the white-noise level based on the energy distribution of the entire block.

4. The audio-information encoding apparatus according to claim 1, further comprising gain-control means that controls the gain of the audio signal on the time axis.

5. An audio-information encoding method for dividing an audio signal on a time axis into blocks for every predetermined time period, frequency transforming and encoding each block, the method comprising:

determining, for each block, a white-noise level of an extracted white-noise component of a frequency transformed audio signal;

generating a first index by quantizing the white-noise level contained in the audio signal, and a second index designating a start location of a random-number table adapted to generate a white-noise component in a decoding side; and encoding, for each block, (i) a quantized value resulting from normalization and quantization of the frequency transformed audio signal, (ii) the first index, and (iii) the second index, wherein said determining and generating steps are performed by a white-noise level determining unit and said encoding step is performed by an encoding unit.

6. A computer program product, comprising a computer usable recording medium having a computer readable program code embodied therein, said computer readable program code adapted to perform an audio-information encoding process of dividing an audio signal on a time axis into blocks for every predetermined time period, frequency transforming and encoding each block, the process comprising:

determining, for each block, a white-noise level of an extracted white-noise component of a frequency transformed audio signal;

generating a first index by quantizing the white-noise level contained in the audio signal, and a second index designating a start location of a random-number table adapted to generate a white-noise component in a decoding side; and encoding, for each block, (i) a quantized value resulting from normalization and quantization of the frequency transformed audio signal, (ii) the first index, and (iii) the second index.

7. An audio-information decoding apparatus for decoding an encoded frequency signal, inverse frequency transforming the decoded frequency signal, thereby generating an audio signal on a time axis, said apparatus comprising:

a white-noise generating unit that generates a white-noise component on the time axis, based on (i) a first encoded index indicating the energy level of the white-noise component and (ii) a second encoded index designating a start location of a random-number table; and an adder that adds the audio signal and the white-noise component on the time axis.

8. The audio-information decoding apparatus according to claim 7, wherein the white-noise generating unit generates the white-noise component based on a specific value contained in a code train.

9. The audio-information decoding apparatus according to claim 8, wherein the specific value is at least one of normalization information and quantization precision information.

10. The audio-information decoding apparatus according to claim 7, further comprising gain compensating means that compensates for the gain of the audio signal, wherein the adder adds the audio signal on the time axis, thus gain-compensated, and the white-noise component on the time axis.

11. An audio-information decoding method for decoding an encoded frequency signal, inverse frequency transforming the decoded frequency signal, thereby generating an audio signal on a time axis, said method comprising:

generating a white-noise component on the time axis, based on (i) a first encoded index indicating the energy level of the white-noise component and (ii) a second encoded index designating a start location of a random-number table; and adding the audio signal and the white-noise component on the time axis, wherein said generating step is performed by a white-noise generating unit, and said adding step is performed by an adder.

12. A computer program product, comprising a computer usable recording medium having a computer readable program code embodied therein, said computer readable program code adapted to perform an audio-information decoding process of decoding an encoded frequency signal, inverse frequency transforming the decoded frequency signal, thereby generating an audio signal on a time axis, said process comprising:

generating a white-noise component on the time axis, based on (i) a first encoded index indicating the energy level of the white-noise component and (ii) a second encoded index designating a start location of a random-number table; and adding the audio signal and the white-noise component on the time axis.

* * * * *